US005822810A

United States Patent [19]

Chen

[11] Patent Number: 5,822,810

[45] Date of Patent: Oct. 20, 1998

[54] SHOWER SCREEN

[76] Inventor: Chang Than Chen, 12F., No. 426, Ming Chuan 2nd Road, Chien Chen Chu, Kaohsiung, Taiwan

[21] Appl. No.: 810,508

[22] Filed: Feb. 27, 1997

[51] Int. Cl.[6] ..... A47K 3/22

[52] U.S. Cl. ..... 4/610; 4/607

[58] Field of Search ..... 4/607, 608, 610, 4/605, 612, 614, 597

[56] References Cited

U.S. PATENT DOCUMENTS

| | | | |
|---|---|---|---|
| 3,418,666 | 12/1968 | Rockey | 4/608 |
| 4,981,164 | 1/1991 | Reichel | 4/610 |
| 5,123,128 | 6/1992 | Hines | 4/610 |

FOREIGN PATENT DOCUMENTS

| | | | |
|---|---|---|---|
| 2615091 | 11/1988 | France | 4/610 |
| 2625895 | 7/1989 | France | 4/610 |

*Primary Examiner*—David J. Walczak
*Attorney, Agent, or Firm*—Charles E. Baxley, Esq.

[57] ABSTRACT

A shower screen includes two posts each having a bracket secured on top for securing a rod in which a rail is secured. The rod includes a groove formed in bottom and the rail includes a duct aligned with the groove of the rod. A number of foldable panels include a number of slides slidably engaged in the groove and the duct for allowing the panels to be folded and unfolded. Two beams are secured to the sides of the panels and each has a rib for engaging with the channel of the post and for preventing spilling. Two sleeves are engaged on the ends of the rod for engaging with the brackets when the rod is short.

5 Claims, 5 Drawing Sheets

SHOWER SCREEN

BACKGROUND OF THE INVENTION

1. Field of the Invention

The present invention relates to a screen, and more particularly to a shower screen.

2. Description of the Prior Art

Typical shower curtains comprise a sheet of water proof cloth material having an upper portion slidably engaged on a top rail. The cloth material may be unfolded to prevent water from spilling when showering. However, the curtain may not suitably prevent water from spilling.

The present invention has arisen to mitigate and/or obviate the afore-described disadvantages of the conventional shower curtains.

SUMMARY OF THE INVENTION

The primary objective of the present invention is to provide a shower screen for preventing water from spilling.

In accordance with one aspect of the invention, there is provided a shower screen comprising a pair of vertical posts each including a longitudinal channel, two brackets secured on top of the posts, a rod including two ends secured in the brackets and including a groove formed in bottom, a rail secured in the rod and including a duct aligned with the groove of the rod, a number of panels pivotally coupled together at a number of live hinges and including a number of slides slidably engaged in the groove of the rod and the duct of the rail for allowing the panels to be folded and unfolded, the panels including two side portions, and two beams secured to the side portions of the panels and each including a rib for engaging with the channel of the post and for preventing spilling. The panels and the beams form a complete screen for preventing water from spilling while showering.

The brackets each includes a key, the groove includes two ends engaged with the keys of the brackets for preventing the rod from rotating relative to the brackets.

Two sleeves are engaged on the ends of the rod for engaging with the brackets when the rod 20 is short, and for allowing the rod to be secured to the brackets.

The sleeves each includes a passageway aligned with the groove and the duct, the rail includes two ends extended inward of the sleeves.

A bar includes two ends secured to bottom of the posts for forming a bottom block member, the beams each includes a notch for engaging with the bar and for preventing the beams from moving beyond the bar.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
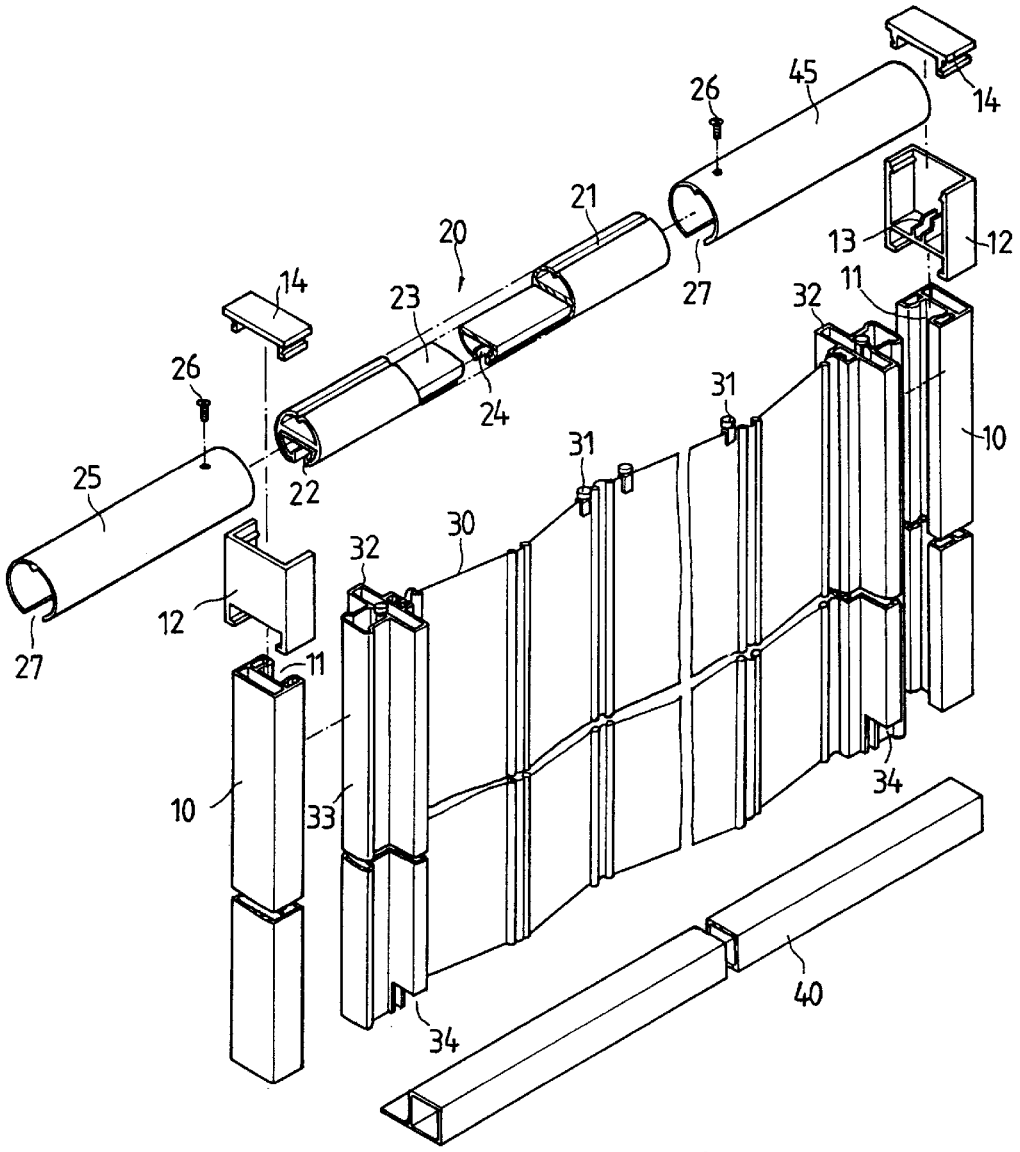
FIG. 1 is an exploded view of a shower screen in accordance with the present invention.
Figure 2:
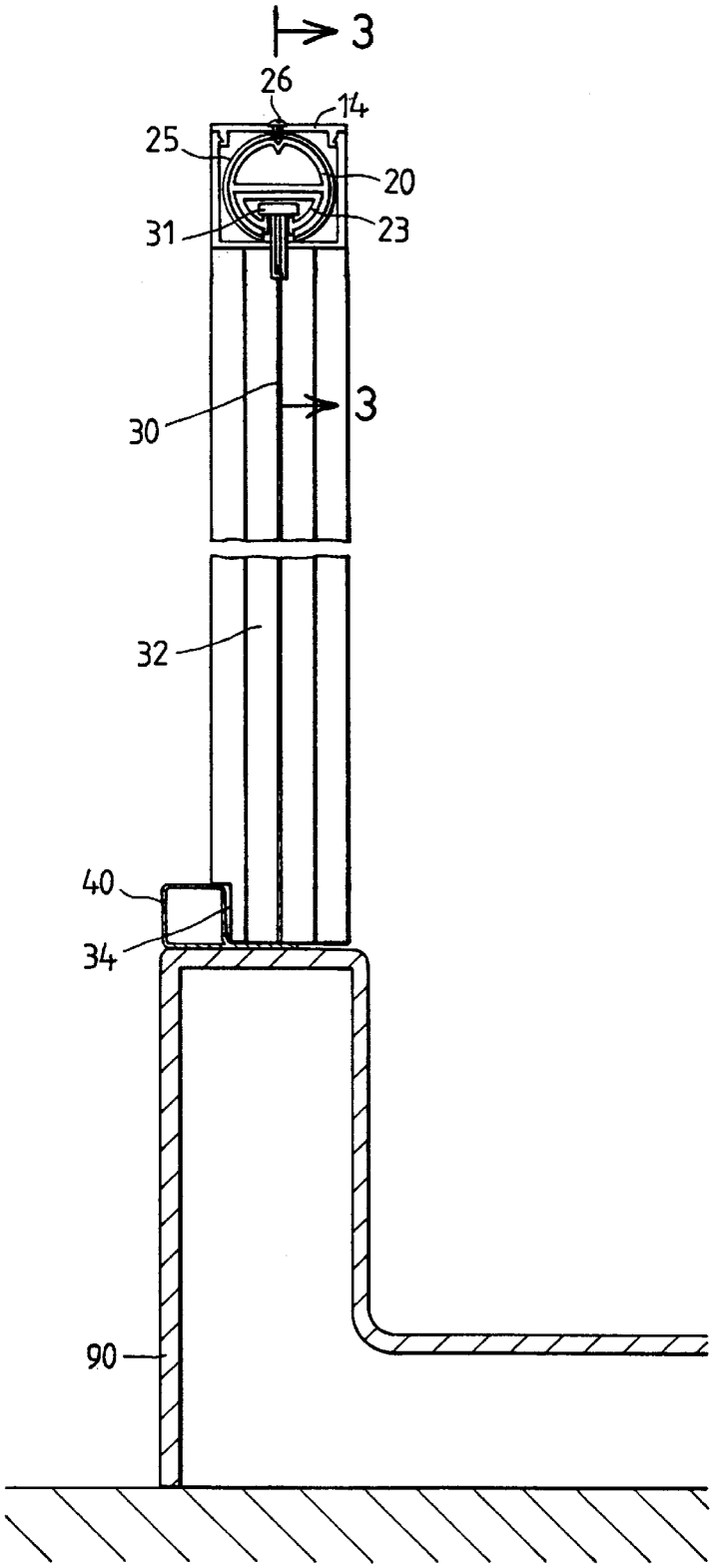
FIG. 2 is a cross sectional view taken along lines 2—2 of FIG. 3.
Figure 3:
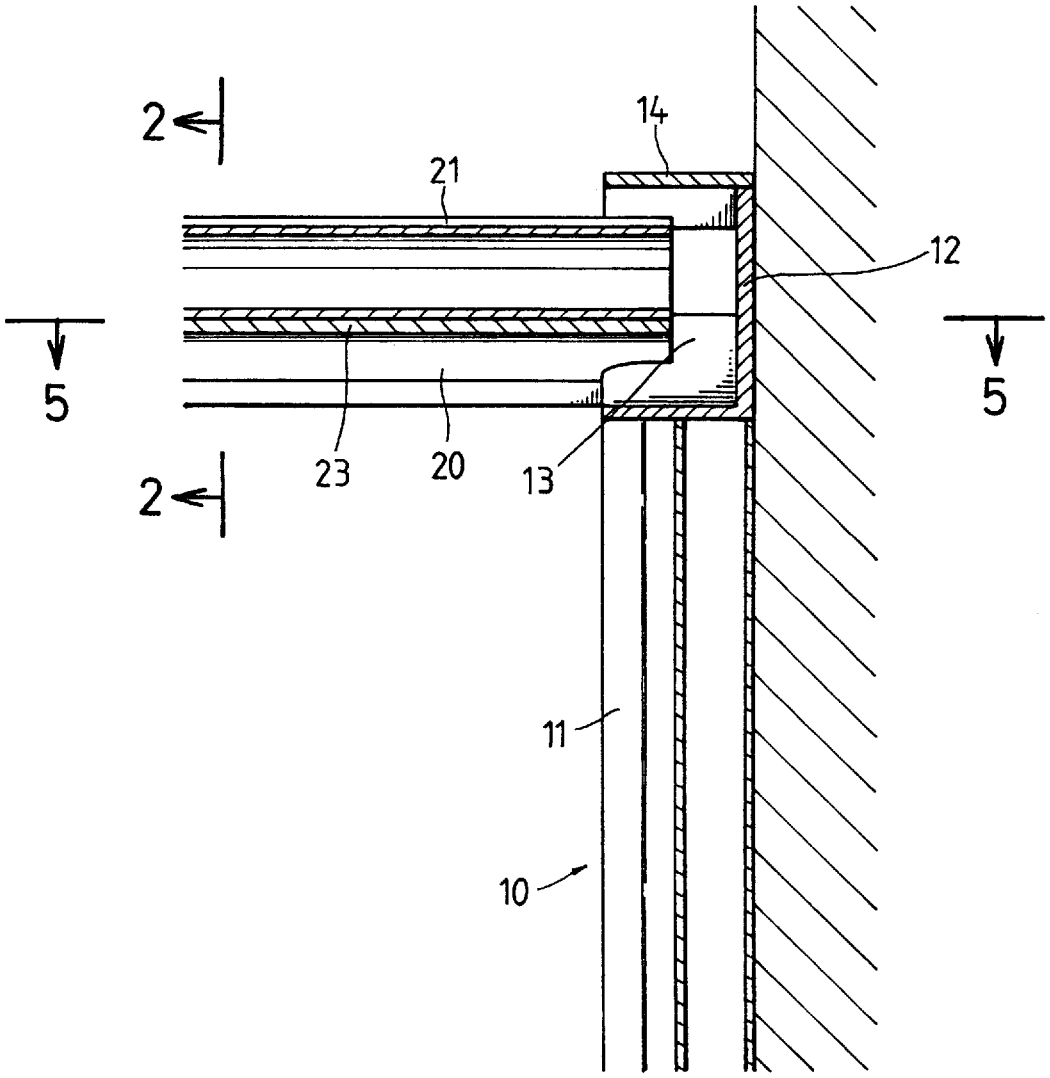
FIGS. 3 and 4 are cross sectional views taken along lines 3—3 of FIG. 2, illustrating two applications of the shower screen.
Figure 4:
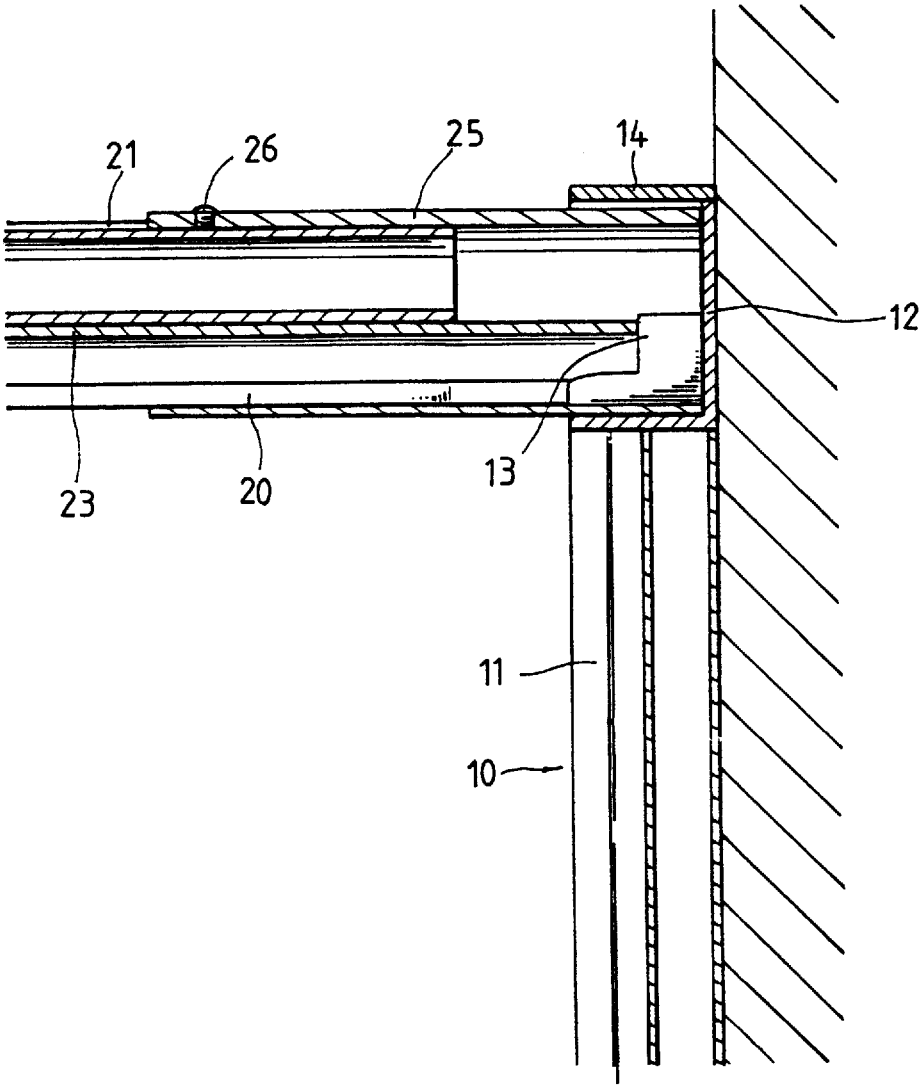

Referring to the drawings, and initially to FIGS. 1 to 3, a shower screen in accordance with the present invention comprises a pair of vertical posts 10 each including a longitudinal channel 11. Two brackets 12 are secured on top of the posts 10 and each includes a key 13. A rod 20 includes two ends engaged in the brackets 12 (FIG. 3) and includes a groove 22 formed in the bottom and having two ends engaged with the keys 13 for preventing the rod 20 from rotating relative to the brackets 12. Two caps 14 are secured on top of the brackets 12 for securing the rod 20 in place. The rod 20 includes a longitudinal slot 21 formed in top and includes a rail 23 secured in the rod 20. The rail 23 includes a duct 24 aligned with the groove 22 of the rod 20. Two sleeves 25 are engaged on the end portions of the rod 20 for engaging with the brackets 12 when the rod 20 is short, best shown in FIG. 4, such that the rod 20 may also be stably secured to the brackets 12. The sleeves 25 each includes a passageway 27 aligned with the groove 22 and the duct 24. Fasteners 26 are engaged with the sleeves 25 and the slot 21 of the rod 20 for securing the rod 20 to the sleeves 25 and for preventing the rod 20 from rotating relative to the sleeves 25. It is preferable that the rail 23 extends inward of the sleeves 25 (FIG. 4), for forming a solid structure.

Figure 5:
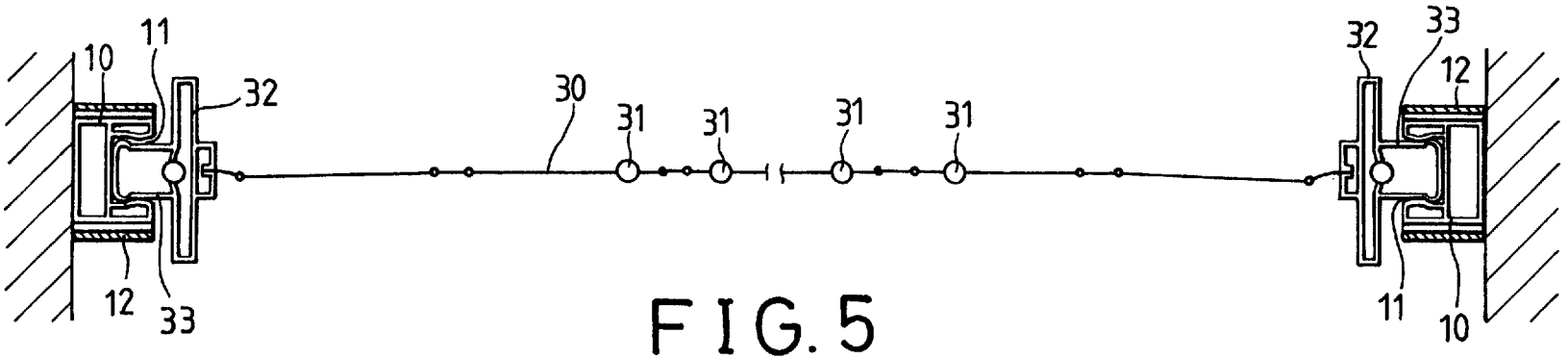
FIGS. 5 and 6 are cross sectional views taken along lines 5—5 of FIG. 3, illustrating the operation of the shower screen.
Figure 6:
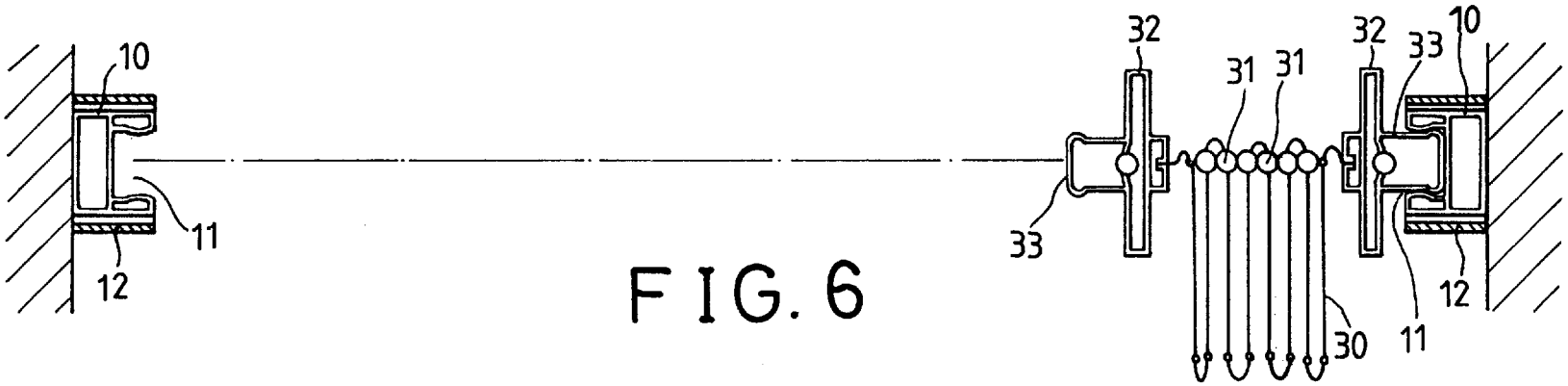

A number of foldable panels 30 include a number of slides 31 slidably engaged in the groove 22 and the duct 24 and the passageway 27 for allowing the panels 30 to be folded (FIG. 6) and unfolded (FIG. 5). Two beams 32 are secured to the side portions of the panels 30 and each includes a rib 33 for engaging with the channel 11 of the posts 10 and for forming a complete screen so as to prevent spilling while showering. A bar 40 is secured in the bottom and has two ends secured to the posts 10 for forming a bottom block member. The beams 32 each includes a notch 34 for engaging with the bar 40 and for preventing the beams 32 from moving outward beyond the bath tub 90 (FIG. 2).

It is to be noted that the panels 30 are pivotally secured together at a number of live hinges for allowing the panels 30 to be folded relative to each other and for forming a perfect screen. The ribs 33 of the beams 32 may be engaged into the channels 11 of the posts 10 so as to form a perfect water proof screen. In addition, the sleeves 25 allow the top rod 20 to be secured to the brackets 12 when the rod 20 is short.

Accordingly, the shower screen in accordance with the present invention includes a complete configuration for preventing water spilling.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shower screen comprising:

a pair of vertical posts each including a longitudinal channel, a bracket secured on top of each of said posts, a rod including two ends secured in said brackets and including a groove formed in a bottom portion thereof, a rail secured in said rod and including a duct aligned with said groove of said rod, a plurality of panels pivotally coupled together at a plurality of live hinges and including a plurality of slides slidably engaged in said groove of said rod and said duct of said rail for allowing said panels to be folded and unfolded, said panels including two side portions, and a beams secured to each of said side portions of said panels and each including a rib for engaging with said channel of said post for preventing spilling.

2. A shower screen according to claim 1, wherein said brackets each includes a key, said groove includes two ends engaged with said keys of said brackets for preventing said rod from rotating relative to said brackets.

3. A shower screen according to claim 1 further comprising two sleeves engaged on said ends of said rod for engaging with said brackets for allowing said rod to be secured to said brackets.

4. A shower screen according to claim 3, wherein said sleeves each includes a passageway aligned with said groove and said duct, said rail includes two ends wherein each rail end extends into a respective one of said sleeves.

5. A shower screen according to claim 1 further comprising a bar including two ends secured to a bottom portion of said posts for forming a bottom block member, said beams each including a notch for engaging with said bar and for preventing said beams from moving beyond said bar.

* * * * *